US006086345A

United States Patent [19]

Acharya et al.

[11] Patent Number: 6,086,345

[45] Date of Patent: Jul. 11, 2000

[54] TWO-PIECE BALANCE PLATE FOR GEROTOR MOTOR

[75] Inventors: Barun Acharya, Hopkins; Michael J. Gust, Chanhassen, both of Minn.

[73] Assignee: Eaton Corporation, Cleveland, Ohio

[21] Appl. No.: 09/245,261

[22] Filed: Feb. 5, 1999

[51] Int. Cl.[7] ..... F03C 2/00

[52] U.S. Cl. ..... 418/61.3; 418/135; 418/77

[58] Field of Search ..... 418/61.3, 135, 418/77

[56] References Cited

U.S. PATENT DOCUMENTS

| | | | |
|---|---|---|---|
| 4,715,798 | 12/1987 | Bernstrom | 418/61.3 |
| 4,741,681 | 5/1988 | Bernstrom | 418/61.3 |
| 4,976,594 | 12/1990 | Bernstrom | 418/61.3 |
| 5,466,137 | 11/1995 | Bierlein et al. . | |
| 5,516,268 | 5/1996 | Kassen et al. | 418/61.3 |
| 5,593,296 | 1/1997 | Bernstrom et al. | 418/61.3 |
| 5,624,248 | 4/1997 | Kassen et al. . | |

*Primary Examiner*—Thomas Denion
*Assistant Examiner*—Theresa Trieu
*Attorney, Agent, or Firm*—L. J. Kasper

[57] ABSTRACT

A gerotor motor of the type having an end cap (13), and a stationary valve plate (15) disposed adjacent a rearward surface of the gerotor gear set (17). Adjacent a forward surface of the gerotor star (27) is a balancing plate assembly (19) including a radially outer balance plate (73) and a radially inner balance plate (75), the balance plates defining inner (77) and outer (79) profiles, respectively, which are closely spaced apart and are radially inward from the gerotor volume chambers (29) to provide sufficient sealing land. The inner balance plate (75) is biased toward the star end surface (81) by a Belleville washer (87). The end surface (81) of the gerotor star (27) defines individual star tooth surfaces (97), each of which includes a radial fluid passage (99) receiving system pressure, and a fluid passage (101) oriented generally perpendicular to the radial passage, and having a decreasing flow volume in a direction away from the radial passage (99). The fluid flowing through the perpendicular fluid passage (101) substantially reduces the tendency for galling to occur between the end surface of the star and the adjacent surface of the balance plate (75).

11 Claims, 5 Drawing Sheets

TWO-PIECE BALANCE PLATE FOR GEROTOR MOTOR

CROSS-REFERENCE TO RELATED APPLICATIONS

Not Applicable

STATEMENT REGARDING FEDERALLY SPONSORED RESEARCH OR DEVELOPMENT

Not Applicable

MICROFICHE APPENDIX

Not Applicable

BACKGROUND OF THE DISCLOSURE

The present invention relates to rotary fluid pressure devices, and more particularly, to such devices which include gerotor displacement mechanisms.

Although the present invention may be used advantageously with gerotor devices which are to be used as fluid pumps, the invention is especially advantageous when utilized as part of a gerotor motor, and particularly those of the low speed, high torque type, and will be described in connection therewith. In addition, the invention is especially advantageous when utilized as part of a gerotor device intended to operate at relatively higher pressures and torques.

Furthermore, although the present invention may be used advantageously with gerotor motors having various types of valving, it is especially advantageous when utilized in a high pressure motor of the "valve-in-star" (VIS) type, and will be described in connection therewith. An example of a VIS motor is illustrated and described in U.S. Pat. No. 4,741,681, assigned to the assignee of the present invention and incorporated herein by reference. In a VIS motor, commutating valving action is accomplished at an interface between an orbiting and rotating gerotor star, and an adjacent, stationary valve plate, which is typically either part of the motor housing (or end cap), or comprises a separate member, but is held rotationally stationary relative to the motor housing. An example of a VIS motor in which the stationary valve member is a member separate from the motor housing is illustrated and described in U.S. Pat. No. 4,976,594, also assigned to the assignee of the present invention and incorporated herein by reference.

Increasingly, low speed, high torque gerotor motors of the kind to which the invention relates, are expected to be able to perform well even in the presence of relatively high back pressures, i.e., a pressure substantially above reservoir pressure at the return (outlet) port of the motor. As is well known to those skilled in the art, high back pressures are common in the case of closed circuit vehicle propel systems in which the system charge pressure is being increased to improve the performance of the servo system which controls the displacement of the hydrostatic, propel pump. As is also well known, the system charge pressure inherently determines the back pressure at the motor, because charge pressure ("make-up" fluid) is communicated to the low pressure side of the system, which is the outlet side of the propel motor.

An inherent characteristic of VIS type motors is that the back pressure exerts a separating force on the gerotor star, tending to separate the star (which is the orbiting and rotating valve member) from the adjacent valving surface on the stationary valve member. As is well known to those skilled in the gerotor motor art, such separation of adjacent valving surfaces will substantially reduce the volumetric efficiency of the motor, the volumetric efficiency being the ratio of the actual output of the motor to the theoretical motor output which would have been, if there had been no leakage within the motor. It has been determined that for certain VIS motor configurations, the star separation issue is not as much of a problem at elevated system pressures, because system pressure is used to bias the gerotor star toward the adjacent surface of the stationary valve member. Instead, the problem may be most noticeable at relatively lower system pressures, when there is less resulting biasing force on the star. It is believed that the problem may be exacerbated by the relatively high bolt torque which is used in view of the fact that the motor is intended for relatively higher pressure applications. The high bolt torque can have the effect of distorting the prior art balancing plate, thus opening up leakage clearances between the gerotor and the balancing plate, and reducing volumetric efficiency. Of greater concern is the fact that the bolt torque results in an unpredictable preload on the balancing plate, in view of variations in factors such as thread finish, etc., whereas what is really desired is a known, predictable preload.

Accordingly, it is an object of the present invention to provide an improved low speed, high torque gerotor motor, and especially a motor of the VIS type, which is able to perform satisfactorily, even in the presence of a relatively higher back pressure, with less of a decrease in volumetric efficiency.

It is another object of the present invention to provide a VIS type gerotor motor having an improved balancing plate and seal arrangement which makes it possible to reduce the gerotor side clearance, for further increased volumetric efficiency, while at the same time, effectively increasing the side clearance tolerance band, thus reducing the manufacturing cost of the gerotor.

Is has been observed that the effort to reduce gerotor side clearance, and increase volumetric efficiency can have one undesirable effect. Increasing the loading on a balancing plate disposed adjacent the forward surface (i.e., the end opposite the stationary valve plate) of the star can result in galling between the end surface of the star tooth and the adjacent surface of the balancing plate, especially at a location of high relative velocity between the adjacent surfaces. As is well known to those skilled in the gerotor motor art, any galling between relatively moving parts is likely to lead fairly quickly to total inoperability of the motor.

Accordingly, it is another object of the present invention to provide an improved gerotor motor which has an increased ability to prevent galling between the end surfaces of the gerotor star and the adjacent surface of the balancing plate.

It is a more specific object of the present invention to provide an improved gerotor motor which achieves the above-stated object by directing pressurized fluid to the area subject to galling, thus cooling and lubricating the area of potential galling.

BRIEF SUMMARY OF THE INVENTION

The above and other objects of the invention are accomplished by the provision of a rotary fluid pressure device comprising housing means defining a fluid inlet port and a fluid outlet port. A fluid pressure displacement mechanism is associated with the housing means and includes an internally toothed ring member and an externally toothed star member eccentrically disposed within the ring member. The ring member and the star member have relative orbital and rotational movement, and interengage to define expanding and contracting fluid volume chambers in response to the orbital and rotational movement. A valve means cooperates with the housing means to provide fluid communication between the fluid inlet port and the expanding volume chambers, and between the contracting volume chambers and the fluid outlet port. The housing means comprises an end cap assembly disposed rearwardly of the ring member and comprising part of the valve means, and a housing member disposed forwardly of the ring member. A plurality of fasteners is disposed in fastener bores, the fasteners maintaining the end cap assembly and the housing member in tight sealing engagement relative to the ring member. A balancing plate is disposed between the ring member and the housing member and is adapted to be closely disposed to an adjacent end surface of the star member, to minimize fluid leakage therebetween.

The improved rotary fluid pressure device is characterized by the balancing plate comprising a balancing plate assembly including an outer balance plate and an inner balance plate. The outer balance plate defines an inner profile disposed radially inwardly from the fluid volume chambers. The inner balance plate has mechanical means associated therewith for biasing the inner balance plate toward engagement with the star member.

In accordance with another aspect of the invention, the improved rotary fluid pressure device is of the type in which the adjacent end surface of the star member defines a fluid chamber, and the star member defines a fluid passage communicating pressurized fluid from the main fluid flow path, upstream of the fluid displacement mechanism, to the fluid chamber to provide a fluid pressure bias of the star member toward the stationary valve member.

The improved rotary fluid pressure device is characterized by the adjacent end surface of the star member comprising a plurality of individual star tooth surfaces. Each of the star tooth surfaces defines a generally radially extending fluid passage in communication with the fluid chamber. Each of the star tooth surfaces further includes a fluid passage oriented generally perpendicular to the radial fluid passage, and having a decreasing flow volume in a direction away from the radial fluid passage, thus providing pressurized fluid between the balancing plate and the adjacent end surface of the star member.

BRIEF DESCRIPTION OF THE DRAWINGS

FIG. 8 is an enlarged, plan view, also taken on line 4—4 of FIG. 1, showing only the gerotor star, made in accordance with another aspect of the invention.

FIG. 9 is a further enlarged, fragmentary view of one star tooth end surface, made in accordance with the present invention.

FIG. 10 is an axial cross-section, taken on line 10—10 of FIG. 9, and on approximately the same scale.

DETAILED DESCRIPTION OF THE PREFERRED EMBODIMENT

Figure 1:
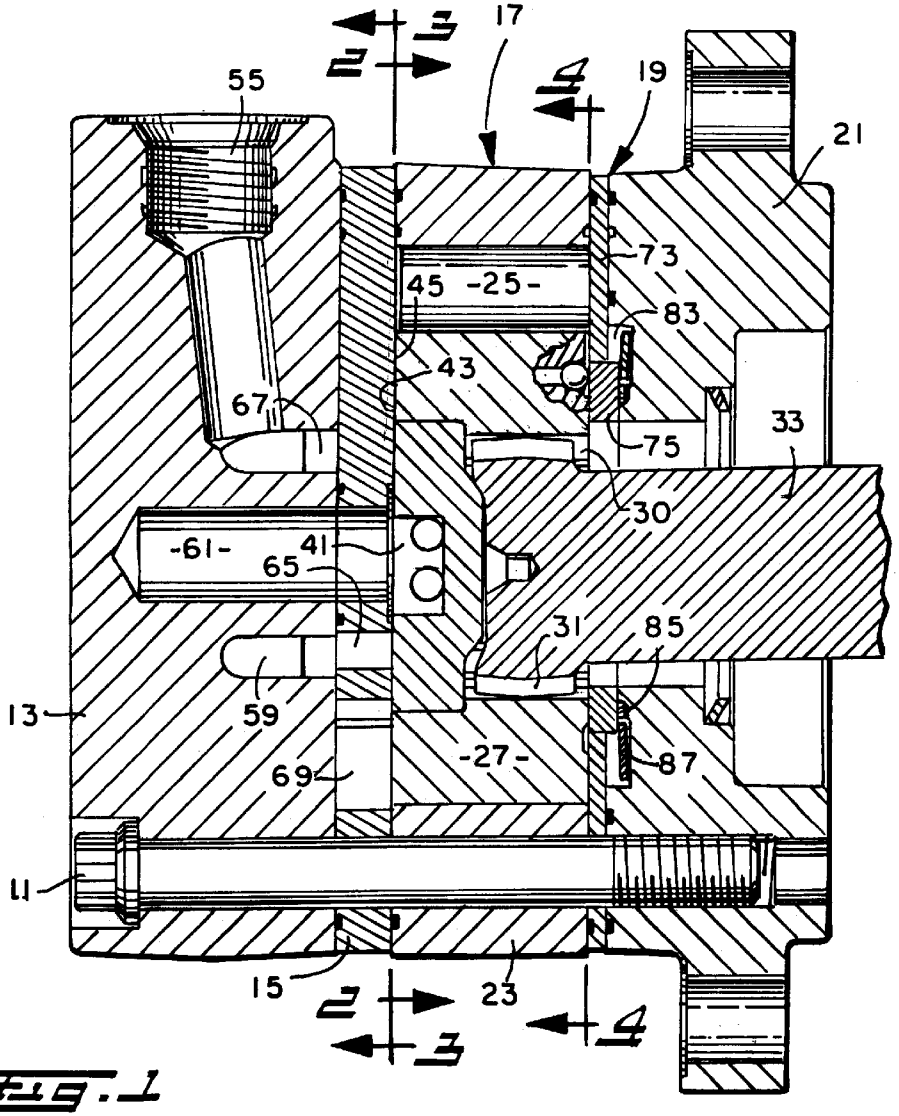
FIG. 1 is an axial cross-section illustrating a low speed, high torque VIS gerotor motor made in accordance with the present invention.

Referring now to the drawings, which are not intended to limit the invention, FIG. 1 illustrates a VIS motor made in accordance with the above-incorporated patents. More specifically, the VIS motor shown in FIG. 1 is, by way of example only, either of a "wetbolt" design, in which the bolts see system pressure, or of a "damp-bolt" design, in which the bolts see case pressure. In either event, the motor may be made in accordance with the teachings of U.S. Pat. No. 5,211,551, also assigned to the assignee of the present invention, and incorporated herein by reference.

Figure 3:
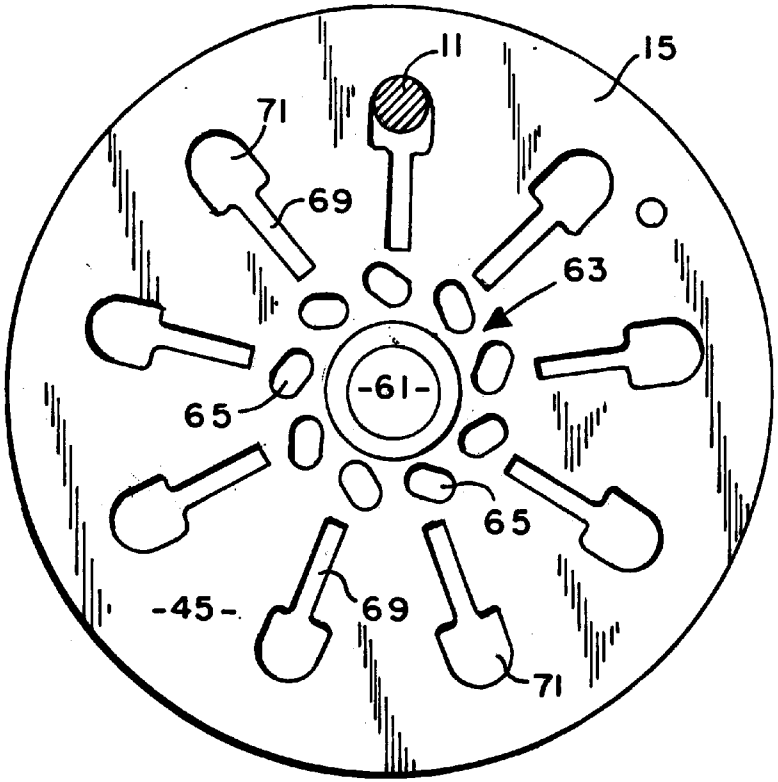
FIG. 3 is a transverse cross-section, taken on line 3—3 of FIG. 1, on a slightly smaller scale than FIG. 1, and rotated somewhat from the position shown in FIG. 1.
Figure 4:
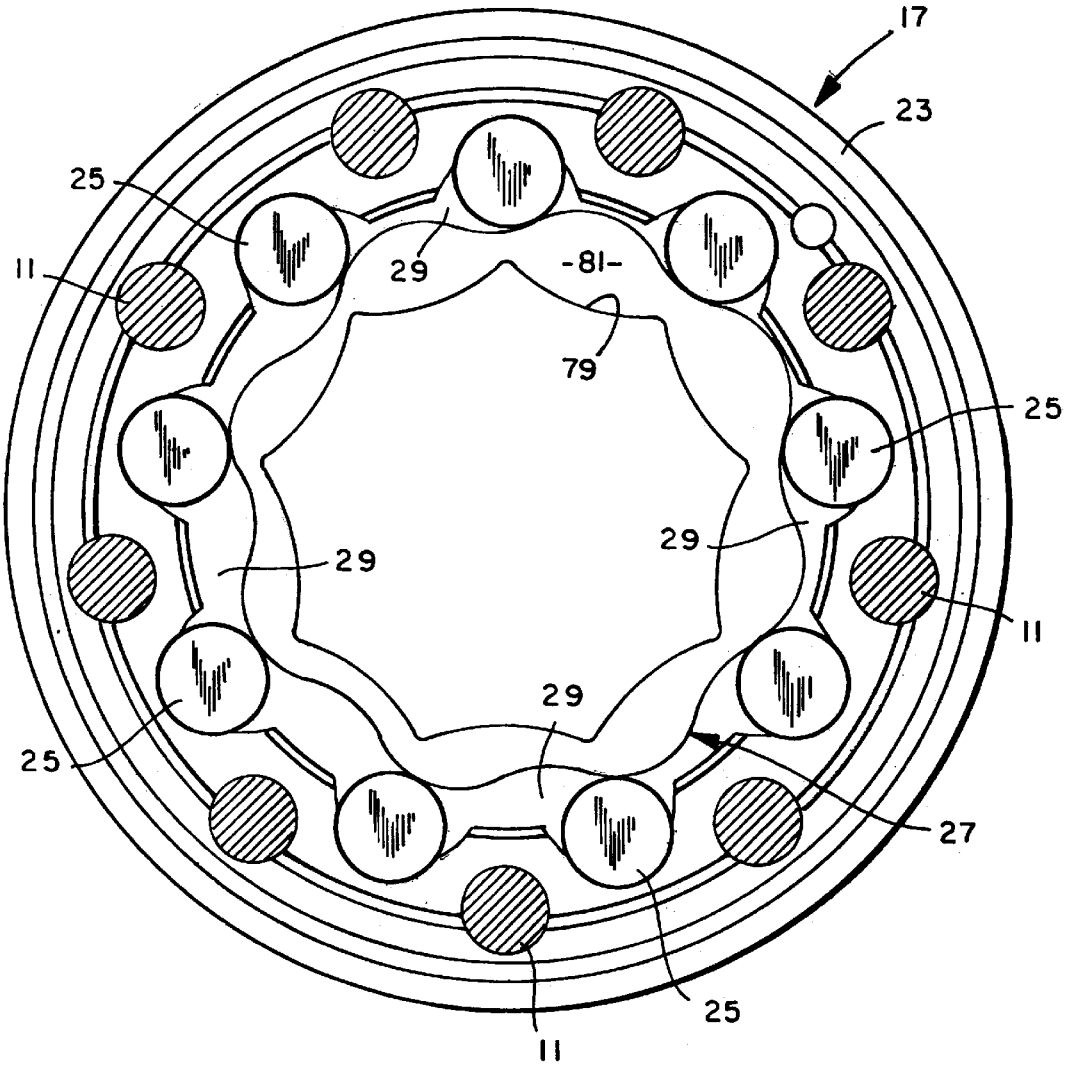
FIG. 4 is a transverse cross-section, taken on line 4—4 of FIG. 1, and on a slightly larger scale, and illustrating somewhat schematically the location of the outer profile of the inner balance plate, which comprises one aspect of the present invention.

The VIS motor shown in FIG. 1 comprises a plurality of sections secured together such as by a plurality of bolts 11, only one of which is shown in each of FIGS. 1 and 3, but all of which are shown in FIG. 4. The motor includes an end cap 13, a stationary valve plate 15, a gerotor gear set, generally designated 17, a balancing plate assembly, generally designated 19, and a flange member 21.

The gerotor gear set 17, also shown in FIG. 4, is well known in the art, is shown and described in greater detail in the above-incorporated patents, and therefore will be described only briefly herein. The gear set 17 is preferably a Geroler® gear set comprising an internally toothed ring member 23 defining a plurality of generally semi-cylindrical openings, with a cylindrical roller member 25 disposed in each of the openings, and serving as the internal teeth of the ring member 23. Eccentrically disposed within the ring member 23 is an externally-toothed star member 27, typically having one less external tooth than the number of internal teeth 25, thus permitting the star member 27 to orbit and rotate relative to the ring member 23. The orbital and rotational movement of the star 27 within the ring 23 defines a plurality of expanding and contracting fluid volume chambers 29.

Referring still primarily to FIG. 1, the star 27 defines a plurality of straight, internal splines 30 (shown in FIGS. 1, 7 and 8), which are in engagement with a set of external, crowned splines 31, formed on one end of a main drive shaft 33 (shown only fragmentarily in FIG. 1). Disposed at the opposite end of the shaft 33 is another set of external, crowned splines, not shown herein, adapted to be in engagement with another set of straight internal splines defined by some form of rotary output member, such as a shaft or wheel hub, also not shown herein. As is well known to those skilled in the art, gerotor motors of the general type shown herein may include an additional rotary output shaft, supported by suitable bearings.

Figure 2:
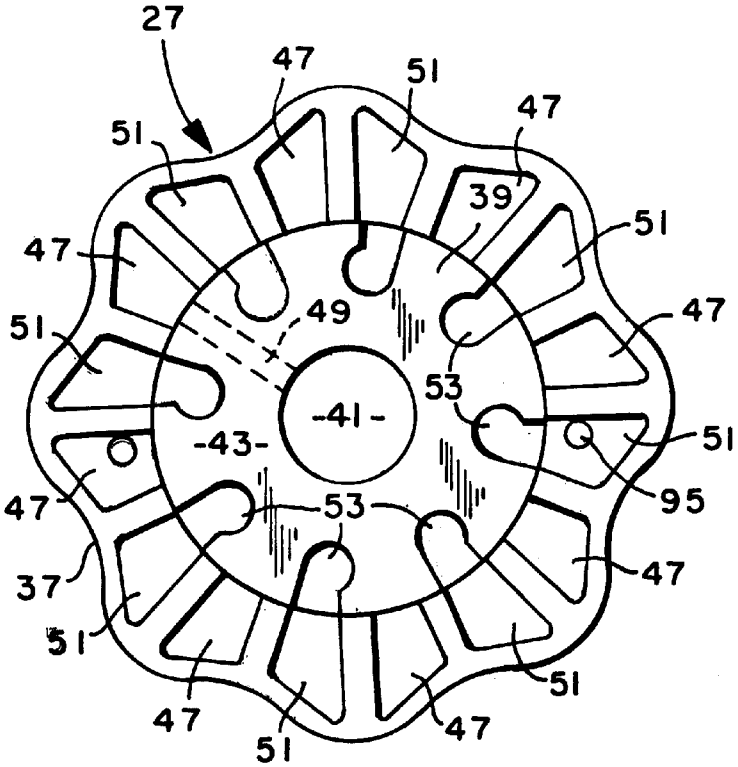
FIG. 2 is a transverse cross-section, taken on line 2—2 of FIG. 1, but showing only the star member.

Referring now primarily to FIG. 2, in conjunction with FIG. 1, the star member 27 will be described in greater detail. Although not an essential feature of the present invention, it is preferable that the star 27 comprise an assembly of two separate parts. In the subject embodiment, the star 27 comprises two separate parts including a main star portion 37, which includes the external teeth, and an insert or plug 39. The main portion 37 and the insert 39 cooperate to define the various fluid zones, passages, and ports which will be described subsequently. The star member 27 defines a central manifold zone 41, defined by an end surface 43 of the star 27, the end surface 43 being disposed in sliding, sealing engagement with an adjacent surface 45 (see FIG. 3) of the stationary valve plate 15.

The end surface 43 of the star 27 defines a set of fluid ports 47, each of which is in continuous fluid communication with the manifold zone 41 by means of a fluid passage 49, defined by the insert 39 (only one of the fluid passages 49 being shown in FIG. 2). The end surface 43 further defines a set of fluid ports 51, which are arranged alternately with the fluid ports 47, each of the fluid ports 51 including a portion 53 which is defined by the insert 39 and extends radially inward, about half way, radially, to the manifold zone 41.

Referring now primarily to FIG. 3, in conjunction with FIG. 1, the end cap 13 and stationary valve plate 15 will be described in further detail. As may be seen from a review of the above-incorporated U.S. Pat. No. 5,211,551, it is known in the art to have the end cap and stationary valve plate formed as separate members, as in the subject embodiment, which then may also be referred to as an "end cap assembly". Alternatively, the end cap and stationary valve may comprise a single, integral part, in which case, reference to a "stationary valve means" or some similar terminology will be understood to refer to the portion of the end cap disposed immediately adjacent the gerotor gear set. It should be understood that the present invention may utilize either construction described above.

The end cap 13 includes a fluid inlet port 55 and further defines an annular chamber 59 which is in open, continuous fluid communication with the inlet port 55. The end cap 13 and the stationary valve plate 15 cooperate to define a cylindrical chamber 61 which, for purposes of the present specification, will be considered part of the outlet port because the chamber 61 would typically be in unrestricted fluid communication with the outlet port, and with the manifold zone 41, as the star 27 orbits and rotates. Surrounding the cylindrical chamber 61 is a fluid pressure region, generally designated 63 (see FIG. 3), which includes a plurality of individual stationary pressure ports 65, each of which is in continuous fluid communication with the annular chamber 59 by means of a passage 67 (see FIG. 1).

The stationary valve plate 15 further defines a plurality of stationary valve passages 69, also referred to in the art as "timing slots". In the subject embodiment, each of the valve passages 69 would typically comprise a radially-oriented slot, each of which would be disposed in continuous, open fluid communication with an adjacent one of the volume chambers 29. Preferably, the valve passages 69 are disposed in a generally annular pattern which is concentric relative to the fluid pressure region 63, as is illustrated in FIG. 3. In the subject embodiment, and by way of example only, the valve passages 69 each open into an enlarged portion 71. Each of the bolts 11 passes through one of the enlarged portions 71, but as may be seen in FIG. 3, even with the bolt 11 present, fluid can still be communicated to and from the volume chambers 29 through the radially inner part of each enlarged portion 71.

Referring again primarily to FIG. 1, the general function of the prior art balancing plate will be described. System pressure (high pressure) is communicated to the forward side (i.e., the side adjacent the flange member 21) of the balancing plate, in accordance with the teachings of above-incorporated U.S. Pat. No. 4,976,594. For either direction of operation, the balancing plate is biased toward the star member 27. In other words, throughout one entire orbit of the star member 27, there is a net force biasing the balancing plate toward the star. However, for various reasons such as a slight tipping or cocking of the star, or uneven distribution of bolt torque, there may have been localized areas in which there would be a slight separation of the balancing plate from the star 27.

During operation, high pressure fluid is communicated to the inlet port 55, and from there flows to the annular chamber 59, then through the individual passages 67 and into the pressure ports 65. As the star 27 orbits and rotates, the nine pressure ports 65 engage in commutating fluid communication with the eight radially inward portions 53 of the fluid ports 51 defined by the star 27. Thus, high pressure fluid is being communicated only to those fluid ports 51 which are in fluid communication with one of the valve passages 69, or are about to have such communication or have just completed such communication.

High pressure fluid is communicated only to those fluid ports 51 which are on the same side of the line of eccentricity as the expanding volume chambers, so that high pressure fluid then flows from those particular fluid ports 51 through the respective stationary valve passages 69, and enlarged portions 71, into the expanding volume chambers 29.

Low pressure exhaust fluid flowing out of the contracting volume chambers 29 is communicated through the respective enlarged portions 71 and valve passages 69 into the fluid ports 47 defined by the star member 27. This low pressure fluid is then communicated through the radial fluid passages 49 into the manifold zone 41, and from there, the low pressure fluid flows through the cylindrical chamber 61, and then to the associated outlet port. It will be understood by those skilled in the art that the overall, main flow path just described is generally well known in the art. As was explained in the BACKGROUND OF THE DISCLOSURE, is there is substantially higher than usual back pressure at the outlet port 61, the result will be an increased separation force acting on the star 27. In the subject embodiment, such an increase in the back pressure would exert an increased biasing force over the entire, transverse area of the manifold zone 41.

Referring now primarily to FIGS. 1 and 4 through 7, the balance plate assembly 19, which comprises one important aspect of the invention, will be described in some detail. The assembly 19 includes an outer balance plate 73, and an inner balance plate 75. As used herein, the terms "outer" and "inner" refer merely to the radial relationship of the plates 73 and 75, i.e., the plate 73 is disposed radially outward, and the plate 75 is disposed radially inward, relative to each other. Another way of describing the relationship of the balance plates 73 and 75 is that the inner plate 75 is "nested" within the outer plate 73.

Figure 6:
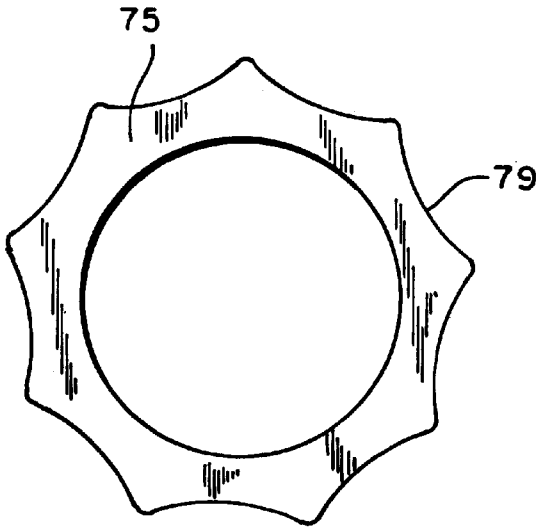
FIG. 6 is a plan view of the inner balance plate of the present invention.
Figure 5:
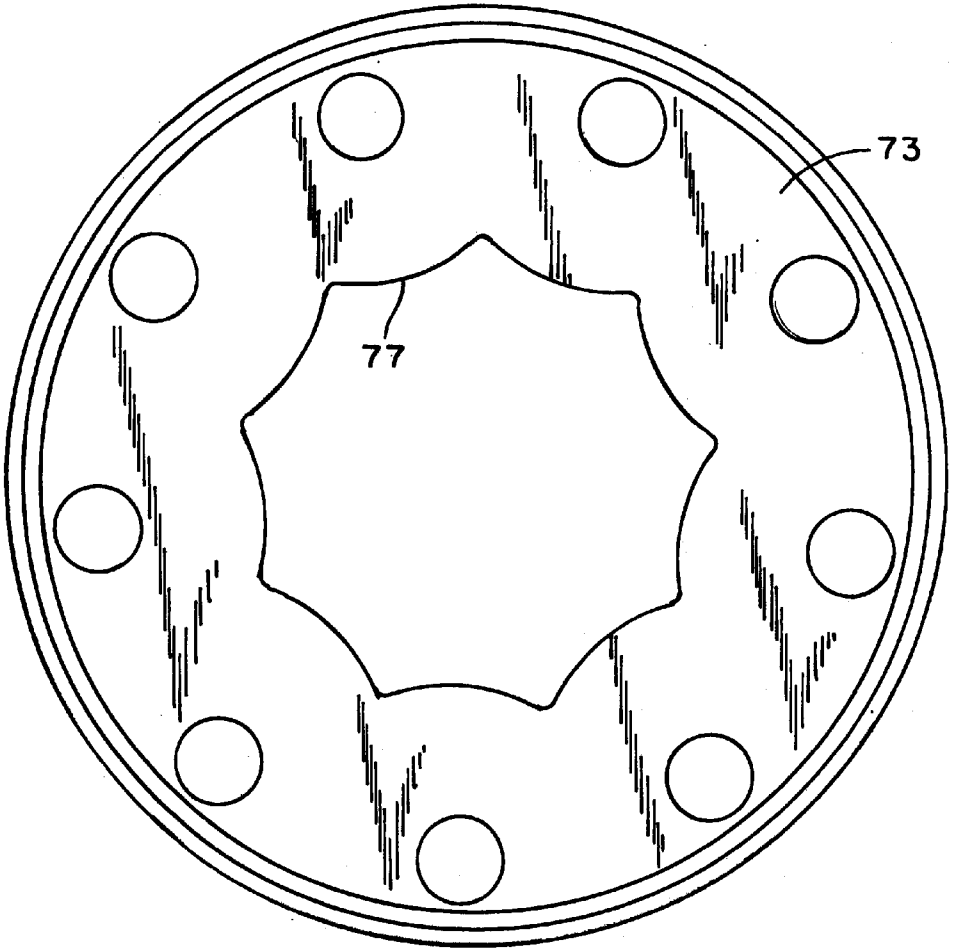
FIG. 5 is a plan view of the outer balance plate of the present invention.
Figure 5:
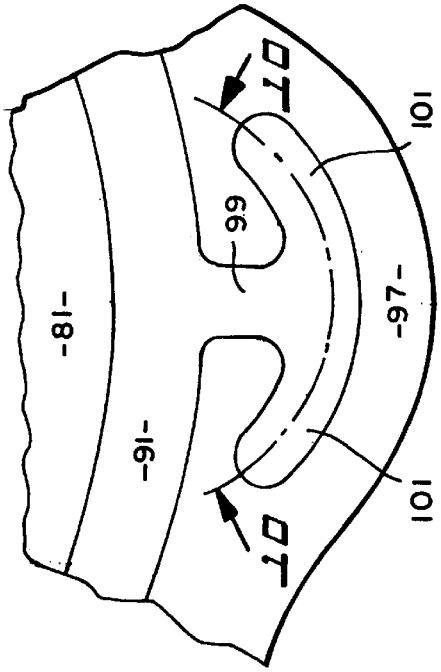
Figure 7:
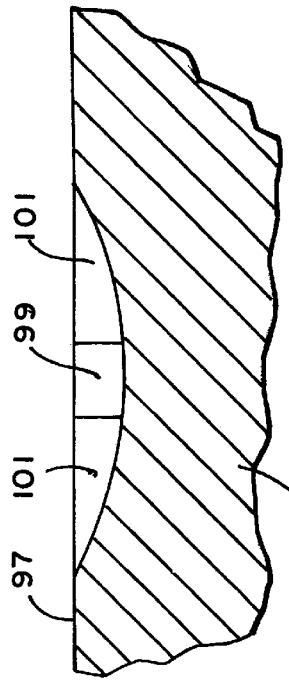
Figure 6:
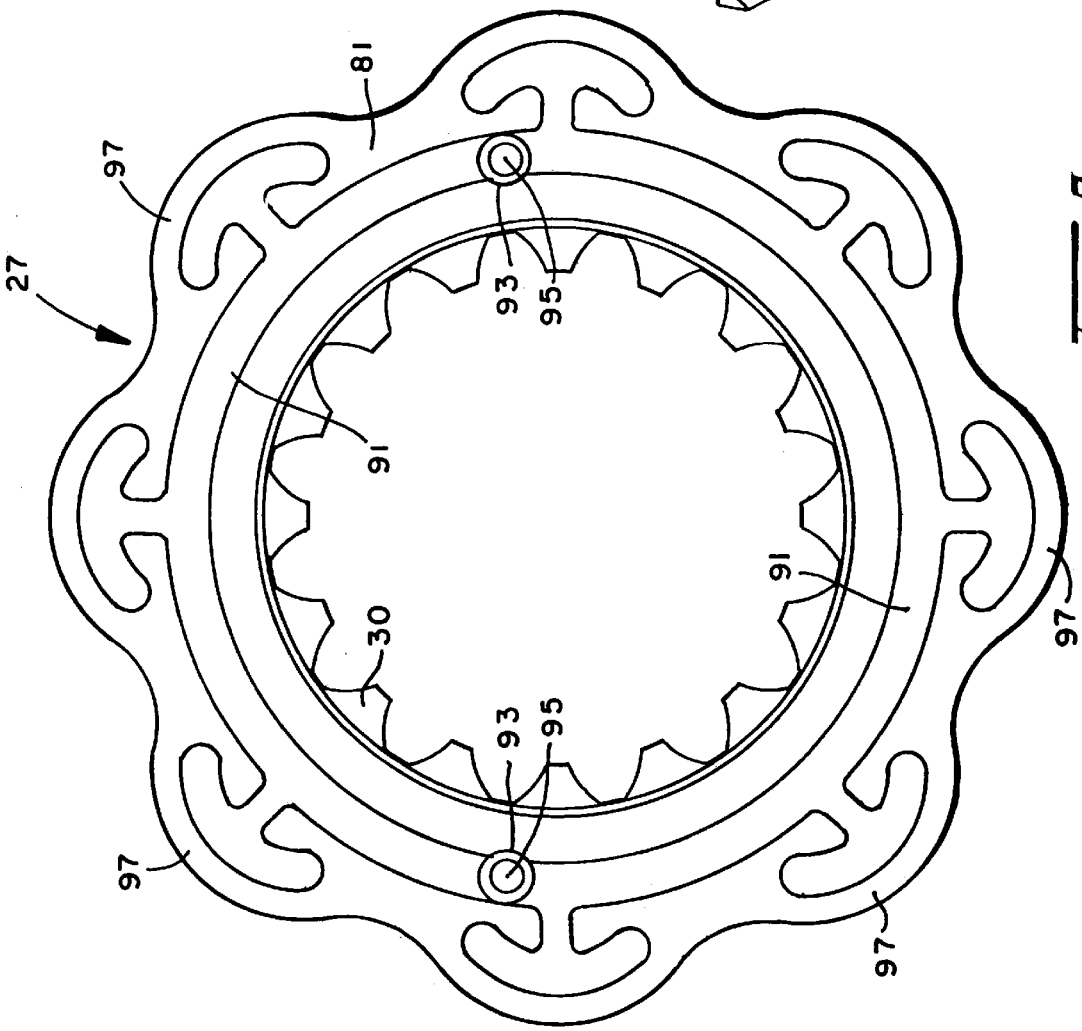

In accordance with a more specific aspect of the invention, the outer balance plate 73 defines an inner profile 77 (see FIG. 5), and the inner balance plate 75 defines an outer profile 79 (see FIGS. 4 and 6). Although not an essential feature of the invention, it is preferred that the inner and outer profiles 77 and 79 be disposed relatively close to each other, within reasonable manufacturing tolerances, such that there would never be an interference between the profiles, but that the radial clearance therebetween would be minimized, and preferably, would be minimized over substantially the entire circumferential extent thereof. For example, in the subject embodiment, the radial clearance is maintained in the range of about 0.020 inches (0.50 mm). Thus, the line labeled "79" in FIG. 4 could also represent the inner profile 77 of the outer plate 73.

Preferably, each of the profiles 77 and 79 is non-circular, because if one or both of the profiles were merely circular, it is likely that the inner balance plate 75 would be free to rotate as the star member 27 orbits and rotates. The result would be substantial friction and heat generation, and possibly wear of the profiles. In the subject embodiment, and by way of example only, the profiles 77 and 79 are polygons, each having nine "sides", thus equaling the number of volume chambers 29 and the number of roller members 25.

In accordance with another important aspect of the invention, the outer profile 79 of the inner balance plate 75 is located as shown in FIG. 4, relative to the volume chambers 29, i.e., for any given orbital and rotational position of the star member 27, there will be at least a small (in a radial direction) sealing land between an end surface 81 of the star 27 and an adjacent surface of the outer balance plate 73. In the subject embodiment of the invention, this was accomplished by fixing a point at the valley of the star and orbiting the star through nine orbits (i.e., one full rotation). The resulting profile thus defined was exactly the same shape as the profiles 77 and 79, but somewhat larger. Then, and by way of example only, because it was desired never to have less than a 0.090 inch (2.2 mm) sealing land, the generated profile was merely reduced by 0.090 inches in the radial direction to generate the profiles 77 and 79. It should be understood that the described profiles and method of generating the same is not essential to the invention, but was preferred herein.

As was noted previously, the inner profile 77 of the outer balance plate 73 is closely spaced apart from the outer profile 79 of the inner balance plate 75. Therefore, all of the end surface 81 which is visible in FIG. 4, radially outward of the outer profile 79, represents the instantaneous sealing land between the end surface 81 and the outer balance plate 73. In other words, the outer balance plate 73 would cover substantially the entire area (seen in FIG. 4) of the gerotor gear set 17, radially outward of the outer profile 79.

Figure 7:
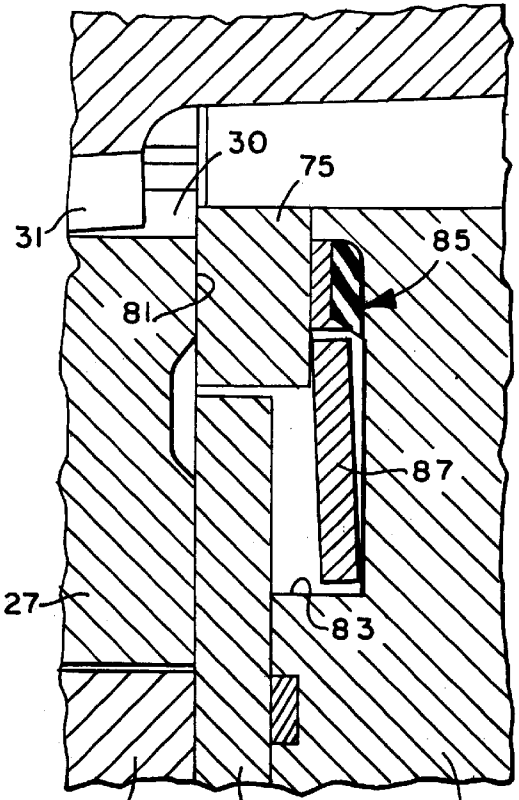
FIG. 7 is a greatly enlarged, fragmentary, axial cross-section, similar to FIG. 1, illustrating the invention in greater detail.

Referring now primarily to FIG. 7, another important aspect of the invention will be described. As is best seen in FIG. 7, the outer balance plate 73 is relatively thin, whereas the inner balance plate 75 is relatively thick. It is believed to be within the ability of those skilled in the art, from a reading and understanding of this specification, to be able to select thicknesses for each of the plates 73 and 75 which are appropriate for the particular motor design. The flange member 21 defines an annular chamber 83 within which is disposed the radially inner periphery of the outer balance plate 73, i.e., that portion which seals against the end surface 81 of the star member. Also disposed within the annular chamber 83 is the inner balance plate 75. In a manner already known in the art, system pressure is communicated into the chamber 83 through the clearance between the profiles 77 and 79, with the system pressure then biasing the balance plates 73 and 75 toward sealing engagement with the adjacent end surface 81 of the star. Also disposed within the annular chamber 83, forwardly of the inner balance plate 75 is a seal ring assembly 85, the function of which is to seal system pressure within the chamber 83, and prevent leakage thereof into the case drain region surrounding the shaft 33.

Disposed radially outward from the seal ring assembly 85 is a Belleville spring 87. The spring 87 has its outer periphery seated against the forward wall of the chamber 83, while its inner periphery is seated against a forward surface of the inner balance plate 75, biasing the plate 75 rearward, into engagement with the end surface 81 of the star member. Thus, it is an important feature of the present invention that the balancing plate assembly 19 comprise two separate balance plates 73 and 75. The outer balance plate 73 is thinner and therefore, conforms to the adjacent end surface of the ring member 23 as well as the adjacent end surface 81 of the star member 27 to seal effectively thereagainst. At the same time, the inner balance plate 75 is thicker, is independent of bolt torque, and is biased by the system pressure (the same as is the outer balance plate 73), but is also biased mechanically by the Belleville spring 87. As a result, the side clearance may be reduced, further increasing the volumetric efficiency, but also permitting an effective increase in the side clearance tolerance band, which simplifies and reduces the cost of manufacture of the gerotor gear set.

Referring now primarily to FIGS. 1 and 8 through 10, another but closely related aspect of the invention will be described in some detail. It should be noted that FIG. 8 is a view looking in the same direction as FIG. 4, but the features on the end surface 81 and shown in FIG. 8 were not shown in FIG. 4, for ease of illustration. As was mentioned in the BACKGROUND OF THE DISCLOSURE, the reduced side clearance between the end surface 81 of the star member 27 and the adjacent surface of the outer balance plate 73, and the greater bias pressure on the balance plate 73, can result in galling, and the feature illustrated in FIGS. 8 through 10 has been found effective in substantially preventing such galling.

In accordance with the teachings of above-incorporated U.S. Pat. No. 4,976,594, the surface 81 of the star member 27 defines and annular recess or groove 91, which receives pressurized fluid from whichever of the ports 47 or 51 contains system (high) pressure, by means of a pair of axial fluid passages 93. It is from the groove 91 that system pressure is communicated into the annular chamber 83. Disposed within each passage 93 is a check ball 95, the function of which is to prevent fluid communication from the groove 91 to whichever of the ports 47 or 51 contains low pressure.

The end surface 81 of the star member 27 comprises, for purposes of subsequent description and the appended claims, a plurality of individual star tooth surfaces 97, each such surface 97 comprising the area radially outward from the groove 91, and disposed circumferentially between adjacent star "valleys", as that term is well understood in the art. Each star tooth surface 97 defines a radially extending fluid passage 99, which is in open communication with the fluid pressure in the groove 91. Each star tooth surface 97 also defines a fluid passage 101 which is oriented generally perpendicular to the radially extending fluid passage 99. More importantly, each fluid passage 101 should extend in generally the direction of linear movement of the star tooth, or more precisely, in a direction perpendicular to the instantaneous rotational moment of the star. As is well known to those skilled in the gerotor art, as the star orbits, it is actually pivoting about a point on one external tooth, such that the maximum linear velocity is occurring at the end surface of the tooth diametrically disposed from the pivot point. Each fluid passage 101 preferably extends along that line of maximum velocity, because it is along such line that galling is most likely to occur. In the subject embodiment, because the motor is preferably bidirectional, there are two of the fluid passages 101 extending from, and in fluid communication with, each radial fluid passage 99.

In accordance with a preferred embodiment, each of the fluid passages 101 has a decreasing flow volume in the direction of fluid flow, i.e., away from the radially extending fluid passage 99. It should be remembered that the star tooth surface 97 is in sealing engagement with the adjacent surface of the outer balance plate 73. Therefore, as fluid flows from the radial passage 99 out through the fluid passage 101, the decreasing flow volume acts as a "nozzle" and effectively increases the localized fluid pressure of fluid flowing from the passage 101 into the side clearance between the star tooth surface 97 and the adjacent surface of the outer balance plate 73. This fluid flowing out of the passage 101 forms a hydrodynamic lift effect and improves the bearing film in the area in which galling would normally be expected to occur, and the fluid flow also serves to cool the region, thus further reducing the tendency for galling to occur.

Theoretically, the passages 99 and 101 could be defined by either the star member 27 or the balance plate 73. However, in view of the fact that the balance plate 73 is relatively thin, and would typically be formed by a process such as stamping, it is more likely that the passages 99 and 101 would be formed in the end surface 81 of the star member.

It is believed to be within the ability of those skilled in the art, based upon a reading and understanding of this specification, to select the dimensions of the various grooves and passages to accomplish the objectives of the invention, i.e., effect a substantial reduction in galling without an undue loss of volumetric efficiency.

The invention has been described in great detail in the foregoing specification, and it is believed that various alterations and modifications of the invention will become apparent to those skilled in the art from a reading and understanding of the specification. It is intended that all such alterations and modifications are included in the invention, insofar as they come within the scope of the appended claims.

What is claimed is:

1. A rotary fluid pressure device comprising housing means defining a fluid inlet port and a fluid outlet port; a fluid pressure displacement mechanism associated with said housing means and including an internally toothed ring member and an externally-toothed star member eccentrically disposed within said ring member; said ring member and said star member having relative orbital and rotational movement, and interengaging to define expanding and contracting fluid volume chambers in response to said orbital and rotational movement; valve means cooperating with said housing means to provide fluid communication between said fluid inlet port and said expanding volume chambers, and between said contracting volume chambers and said fluid outlet port; said housing means comprising an end cap assembly disposed rearwardly of said ring member and comprising part of said valve means, and a housing member disposed forwardly of said ring member; a plurality of fasteners disposed in fastener bores, said fasteners maintaining said end cap assembly and said housing member in tight sealing engagement relative to said ring member; and a balancing plate disposed between said ring member and said housing member and adapted to be closely disposed to an adjacent end surface of said star member, to minimize fluid leakage therebetween; characterized by:

(a) said balancing plate comprising a balancing plate assembly including an outer balance plate and an inner balance plate;

(b) said outer balance plate defining an inner profile disposed radially inwardly from said fluid volume chambers;

(c) said inner balance plate having mechanical means associated therewith for biasing said inner balance plate toward engagement with said star member.

2. A rotary fluid pressure device as claimed in claim 1, characterized by said fluid pressure displacement mechanism comprising a stationary ring member and an orbiting and rotating star member; and each of said plurality of fasteners extends through an opening defined by said ring member.

3. A rotary fluid pressure device as claimed in claim 1, characterized by said valve means being disposed, at least partially, rearwardly of said ring member, and said end cap assembly defining said fluid inlet port and said fluid outlet port.

4. A rotary fluid pressure device as claimed in claim 1, characterized by said housing means comprises a stationary valve member disposed axially between an end cap member and said fluid pressure displacement mechanism, said stationary valve member defining a plurality of stationary valve passages, one of said passages being in continuous fluid communication with each of said expanding and contracting fluid volume chambers.

5. A rotary fluid pressure device as claimed in claim 4, characterized by said externally-toothed star member defining a first set of fluid ports in communication with said fluid inlet port, and a second set of fluid ports in communication with said fluid outlet port, said first and second sets of fluid ports being in commutating fluid communications with said stationary valve passages.

6. A rotary fluid pressure device as claimed in claim 2, characterized by said inner balance plate defining an outer profile disposed radially inwardly from said inner profile of said outer balance plate, and closely spaced apart therefrom, said inner profile and said outer profile being noncircular, whereby said inner balance plate is prevented from rotation, relative to said outer balance plate, in response to said orbiting and rotation movement of said star member.

7. A rotary fluid pressure device as claimed in claim 1, characterized by said outer balance plate comprising a relatively thinner, relatively more compliant member, in the axial direction, and said inner balance plate comprising a relatively thicker, relatively more rigid member, in the axial direction.

8. A rotary fluid pressure device as claimed in claim 1, characterized by said housing member defining a chamber in which is disposed at least a radially inner portion of said outer balance plate and at least a radially outer portion of said inner balance plate, said fluid pressure displacement mechanism defining passage means operable to communicate pressurized fluid to said chamber to bias said radially inner portion of said outer balance plate toward engagement with said star member.

9. A rotary fluid pressure device as claimed in claim 8, characterized by said mechanical means for biasing said inner balance plate toward engagement with said star member comprises a Belleville washer disposed in said chamber, forwardly of said inner balance plate.

10. A rotary fluid pressure device as claimed in claim 9, characterized by said outer balance plate comprising a relatively thinner member, in the axial direction, and said inner balance plate comprising a relatively thicker member, in the axial direction.

11. A rotary fluid pressure device comprising housing means defining a fluid inlet port and a fluid outlet port; a fluid pressure displacement mechanism associated with said housing means and including an internally toothed ring member and an externally-toothed star member eccentrically disposed within said ring member; said ring member and said star member having relative orbital and rotational movement, and interengaging to define expanding and contracting fluid volume chambers in response to said orbital and rotational movement; valve means cooperating with said housing means to provide fluid communication between said fluid inlet port and said expanding volume chambers, and between said contracting volume chambers and said fluid outlet port; said housing means comprising an end cap assembly disposed rearwardly of said ring member and comprising part of said valve means, and a housing member disposed forwardly of said ring member; a plurality of fasteners disposed in fastener bores, said fasteners maintaining said end cap assembly and said housing member in tight sealing engagement relative to said ring member; and a balancing plate disposed between said ring member and said housing member and adapted to be closely disposed to an adjacent end surface of said star member, to minimize fluid leakage therebetween; said adjacent end surface of said star member defining a fluid chamber, and said star member defining a fluid passage communicating pressurized fluid from said main fluid flow path, upstream of said fluid displacement mechanism, to said fluid chamber to provide a fluid pressure bias of the star member toward said stationary valve member; characterized by:

(a) said adjacent end surface of said star member comprising a plurality of individual star tooth surfaces;

(b) each of said star tooth surfaces defining a generally radially extending fluid passage in communication with said fluid chamber;

(c) each of said star tooth surfaces further including a fluid passage oriented generally perpendicular to said radial fluid passage, and having a decreasing flow volume in a direction away from said radial fluid passage, thus providing pressurized fluid between said balancing plate and said adjacent end surface of said star member.

* * * * *